US009180582B2

(12) United States Patent
Firzlaff

(10) Patent No.: US 9,180,582 B2
(45) Date of Patent: Nov. 10, 2015

(54) CYLINDER LINER INSTALLATION TOOL AND METHOD OF USE THEREOF

(71) Applicant: Service Solutions U.S. LLC, Warren, MI (US)

(72) Inventor: Tim Firzlaff, Mankato, MN (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 330 days.

(21) Appl. No.: 13/827,191

(22) Filed: Mar. 14, 2013

(65) Prior Publication Data

US 2014/0137406 A1 May 22, 2014

Related U.S. Application Data

(60) Provisional application No. 61/729,209, filed on Nov. 21, 2012.

(51) Int. Cl.
*B25B 27/06* (2006.01)
*B25B 27/00* (2006.01)

(52) U.S. Cl.
CPC ..... *B25B 27/06* (2013.01); *B25B 27/0035* (2013.01); *Y10T 29/49272* (2015.01); *Y10T 29/53943* (2015.01)

(58) Field of Classification Search
CPC ..... Y10T 29/49272; Y10T 29/53943; B25B 27/06; B25B 27/0035
See application file for complete search history.

(56) References Cited

U.S. PATENT DOCUMENTS 4,598,613 A * 7/1986 Baum ..... 81/3.37

* cited by examiner

*Primary Examiner* — Richard Chang
(74) *Attorney, Agent, or Firm* — Baker & Hostetler LLP

(57) ABSTRACT

A cylinder liner installation tool for seating a cylinder liner into an engine block includes a body having a handle mount section at a proximal end and a head bolt mounting section at a distal end, a press rod attached to the body toward the distal end by a hinge mount, a press plate attached to the press rod, and a handle extension removably attached to the handle mount section, wherein the head bolt mounting section is configured to receive a head bolt mounted to the engine block so that application of an applied force to the handle extension results in a translation of the force down the press rod to the press plate. A method of installing a cylinder liner into a cylinder bore in an engine block includes using a cylinder liner installation tool.

18 Claims, 7 Drawing Sheets

CYLINDER LINER INSTALLATION TOOL AND METHOD OF USE THEREOF

CROSS-REFERENCE TO RELATED APPLICATIONS

This application claims priority to U.S. Patent Application Ser. No. 61/729,209, filed on Nov. 21, 2012, the disclosure of which is incorporated herein by reference in its entirety.

FIELD OF THE DISCLOSURE

The disclosure generally relates to cylinder liners, and, more particularly, to methods and tools for installing cylinder sleeves in engine block sleeve bores.

BACKGROUND OF THE DISCLOSURE

The work derived from an internal combustion engine is the result of the reciprocating motion of pistons seated in cylinders bored into an engine block. Each cylinder seats a piston that translates back and forth through the cylinder space as a result of the timed combustion of a fuel source with an oxidizer in the combustion chamber section of the cylinder. In turn, the reciprocating motion of the pistons rotates a crankshaft from which mechanical energy is derived for a particular use, such as operation of a vehicle.

The cylinder walls of an engine block are subject to enormous wear and tear as a result of the reciprocating motion of the pistons and the high temperatures and pressures experienced during operation of the engine. For example, the piston rings used to seat the piston in the cylinder rub against the cylinder walls. Although a thin film of oil is applied to coat the cylinder walls and reduce the friction and wear on the cylinder walls, the continual motion of the piston rings under extreme operating conditions will eventually cause the cylinder walls to become worn. The cylinder walls may change shape, for example, impacting the efficiency of the engine and/or eventually leading to a catastrophic failure of the engine. In some cases, worn cylinders may be rebored and refitted with larger diameter pistons to restore proper clearances and extend the life of the engine. However, there is a limit to how many times the cylinders may be rebored and refitted with new pistons before the block must be replaced.

To combat the wear and tear on cylinder walls, especially in engines used with large machinery, for example, which may be subject to large and/or continuous workloads, replaceable cylinder liners or sleeves may be fitted into the cylinders. The cylinder liners are typically made of a harder metal, such as an iron alloy, to protect the cylinder walls and may be replaced if becoming worn. The cylinder liners may be installed into the cylinder bore of an engine block by interference fit. This involves heating the engine block to expand the cylinder bore, sliding the cylinder liner into place, and allowing the engine block to cool so that the cylinder bore contracts around the cylinder liner. However, in many cases, and particularly in the case where a worn cylinder liner is being replaced with the engine in chassis at a repair facility, a new cylinder liner is simply press fit into the cylinder bore. Specially designed tools are required to remove the old cylinder liner as well as install a new cylinder liner.

Conventional cylinder liner installing tools have a long, rigid handle to allow a user to gain significant leverage when trying to apply the necessary force to press fit the cylinder liner into the cylinder bore. These conventional installing tools can be extremely difficult to use when space is limited, for example, and/or when the user is presented with an unusual configuration. In addition, conventional cylinder liner installing tools may be difficult to center on the cylinder liner, which can increase the difficulty of inserting the cylinder liner into the cylinder as well as the chance of damaging the cylinder liner during installation. The present disclosure is directed to a tool and methods for overcoming the difficulties presented by conventional install tools, allowing for an easier and more efficient installation of a cylinder liner into the cylinder bore.

SUMMARY OF THE DISCLOSURE

The foregoing needs are met by the present disclosure, wherein according to certain aspects, a cylinder liner installation tool for seating a cylinder liner into an engine block includes a body having a handle mount section at a proximal end and a head bolt mounting section at a distal end, a press rod attached to the body toward the distal end by a hinge mount, a press plate attached to the press rod, and a handle extension removably attached to the handle mount section, wherein the head bolt mounting section is configured to receive a head bolt mounted to the engine block so that application of an applied force to the handle extension results in a translation of the force down the press rod to the press plate.

In accordance with another aspect of the present disclosure, a method of installing a cylinder liner into a cylinder bore in an engine block includes providing an insertion tool that has a body having a handle mount section at a proximal end and a head bolt mounting section at a distal end, a press rod hingedly attached to the body toward the distal end and a press plate attached to the press rod, inserting the cylinder liner into the cylinder bore, centering the press plate over the cylinder liner, extending a head bolt through the head bolt mounting section of the insertion tool and attaching the head bolt to the engine block, attaching a handle extension to the handle mount section, and applying force to the handle extension in order that the insertion tool translates the force down the press rod to the press plate.

In accordance with yet other aspects of the present disclosure, a cylinder liner installation tool includes a body having a handle mount section at a proximal end and a head bolt mounting section at a distal end, a press rod attached to the body, a press plate attached to the press rod, and means for removably attaching a handle extension to the handle mount section.

There has thus been outlined, rather broadly, certain aspects of the present disclosure in order that the detailed description herein may be better understood, and in order that the present contribution to the art may be better appreciated.

In this respect, before explaining at least one embodiment of the invention in detail, it is to be understood that the invention is not limited in its application to the details of the construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE DISCLOSURE

Figure 1:
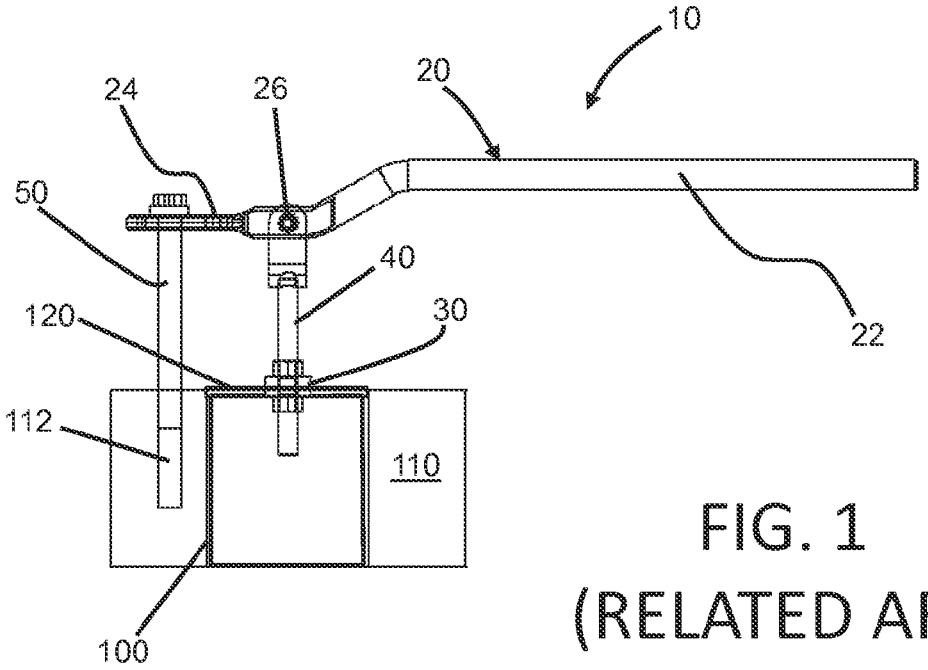
FIG. 1 (RELATED ART)
FIG. 1 is a side view of a related cylinder liner installation tool.

Embodiments in accordance with the invention will now be described with reference to the drawing figures, in which like reference numerals refer to like parts throughout.

Various aspects of methods and tools for installation of a cylinder liner into an engine block may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of a cylinder liner installing tool in addition to the orientation depicted in the drawings. By way of example, if aspects of methods and tools for installation of a cylinder liner into an engine block shown in the drawings are turned over, elements described as being on the "bottom" side of the other elements would then be oriented on the "top" side of the other elements. The term "bottom" can therefore encompass both an orientation of "bottom" and "top" depending on the particular orientation of the apparatus.

Figure 2:
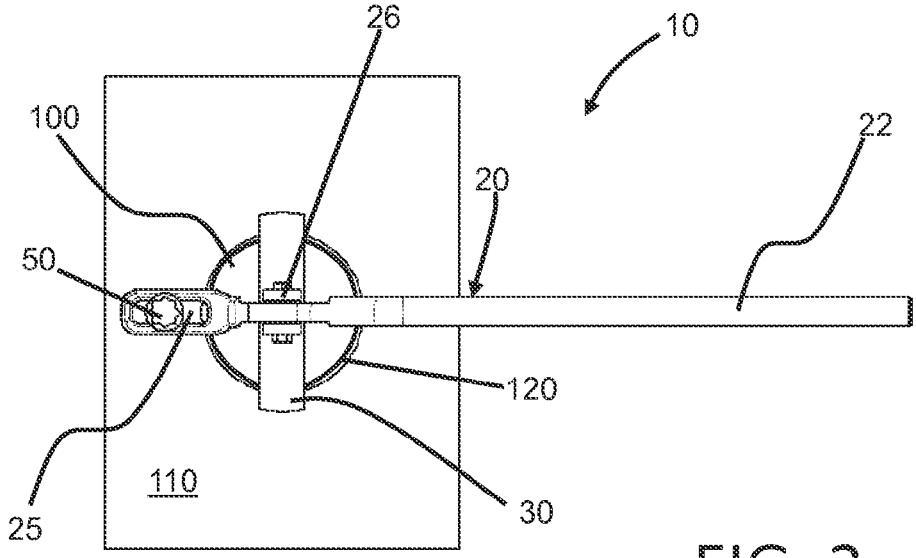
FIG. 2 (RELATED ART)
FIG. 2 is a top view of a related cylinder liner installation tool.
Figure 3:
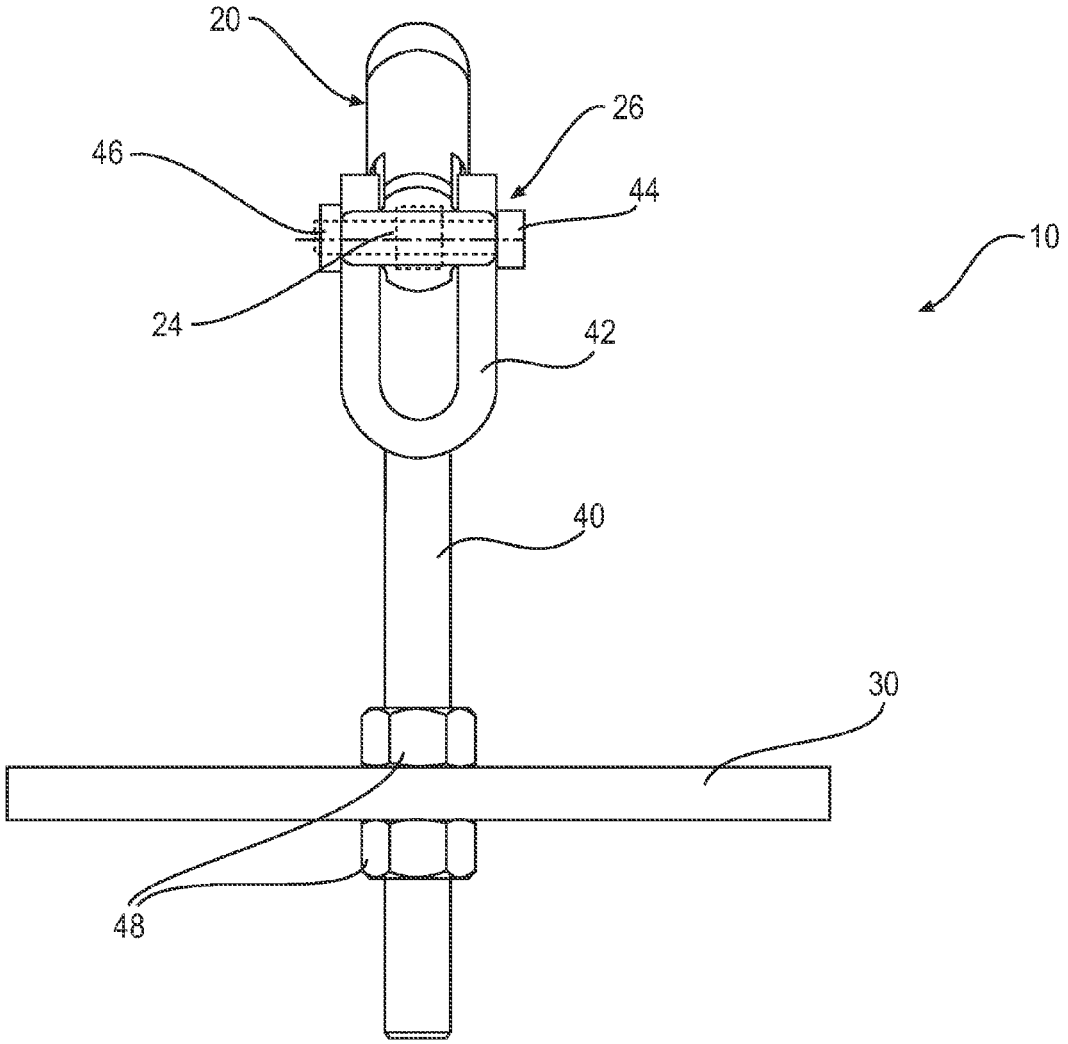
FIG. 3 (RELATED ART)
FIG. 3 is a front view of a related cylinder liner installation tool.

FIGS. 1 and 2 depict a related cylinder liner install tool 10 used for installation of a cylinder liner into a cylinder 100 of an engine block 110. The related install tool 10 comprises a long, integrally formed rigid body 20 having a long, rigid handle section 22 at a proximal end and head bolt mounting section 24 at a distal end. A hinge mount 26 is provided toward the distal end of the rigid body 20, between the handle section 22 and the head bolt mounting section 24, and a press plate 30 is mounted to the body 20 of the install tool 10 via a press rod 40. As also shown in FIG. 3, the press rod 40 may be formed with a U-bracket mount 42 for easy assembly, disassembly, and storage of the component parts of the tool 10. The U-bracket mount 42 is connected to the hinge mount 26 of the body 20 by a suitable attachment means, such as a bolt 44 and nut 46. Thus, the press rod 40 and press plate 30 pivot about the hinge mount 26. In addition, the press rod 40 may be configured with external threading so that the press plate 30 can be adjusted to multiple positions along the length of the press rod 40 through use of repositioning nuts 48.

Figure 4:
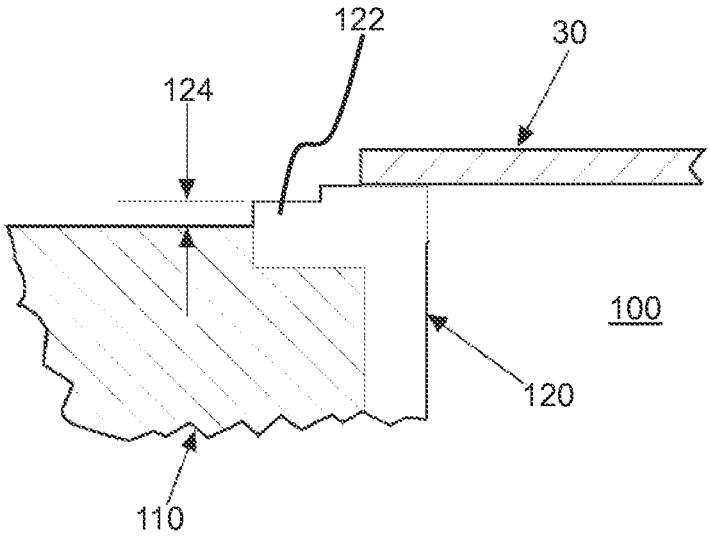
FIG. 4 (RELATED ART)
FIG. 4 is a side sectional view of aspects of a cylinder liner installation tool in a position of use, in accordance with aspects of the present disclosure.

As shown in the enlarged view of FIG. 4, to use the device, a cylinder liner 120 is inserted into the cylinder bore 100 of engine block 110. The related install tool 10 is placed above the cylinder liner 120 so that the press plate 30 is centered as much as possible on the cylinder liner 120. As shown in FIGS. 1 and 2, the head bolt mounting section 24 of the body 20 is formed with a slot 25 (see FIG. 2) for receiving a head bolt 50. A head bolt 50 is extended through the slot 25 and threaded into a head bolt hole 112 in the engine block 110 (see FIG. 1). At this point, depending on the length of the liner 120 extending above the cylinder bore 100, the repositioning nuts 48 may be adjusted to provide for nearly perpendicular application of force through the press rod 40 to the press plate 30. In so doing, the press rod 40 is substantially parallel to the head bolt 50 and the handle section 22 extends substantially parallel to the plane of the press plate 30. It may be useful when installing the cylinder liner 120 to insure that even force is applied to the cylinder liner 120. Due to the tight tolerances involved with the cylinder liner 120 when press fit, any angle of the cylinder liner 120 induced by uneven installation pressure can result in damage to the liner 120 and/or difficulty in getting the cylinder liner 120 to properly seat in the cylinder bore 100.

With the related tool 10 situated and set above the cylinder liner 120, as shown in FIGS. 2 and 4, leverage may be applied to the handle 22. With the hinge mount 26 acting as a fulcrum (see FIG. 1), the head bolt 50 resists rotation of the tool 10 so that the torque generated by the force applied toward the end of the handle 22 translates into a magnified force applied longitudinally through the press rod 40 to the press plate 30. The press plate 30, in turn, engages the cylinder liner 120 and hopefully applies an evenly distributed insertion force against the flange 122 of the cylinder liner 120. The cylinder liner 120 may thus be forced into the cylinder bore 100 and seated with the flange 122 of the liner 120 protruding a predetermined distance from the top of the block 110. A dial indicator sled gauge, for example, may be used to measure the liner protrusion 124 to ensure it is within allowable tolerance.

FIGS. 5-10 illustrate aspects of the present disclosure in which an installation tool 210 comprises a body 220 having a truncated handle mount section 222 at a proximal end and a head bolt mounting section 224 at a distal end. A hinge mount 226 is provided toward the distal end of the rigid body 220, between the handle mount section 222 and the head bolt mounting section 224, and a press plate 230 may be mounted to the body 220 of the installation tool 210 via a press rod 240. The press rod 240 extends through an orifice in the center of the press plate 230. The press rod 240 may be formed with a U-bracket mount 242 for easy assembly, disassembly and/or storage of the tool 210. The U-bracket mount 242 may be connected to the hinge mount 226 of the body 220 by a suitable attachment means, such as a bolt 244 and nut 246 (see FIG. 9). Thus, the hinge mount 226 may serve as a fulcrum for rotation of the body 220 with respect to the rod 240 and press plate 230. In addition, the press rod 240 may be configured with external threading so that the press plate 230 can be adjusted to multiple positions along the length of the press rod 240 through use of repositioning nuts 248.

Figure 8:
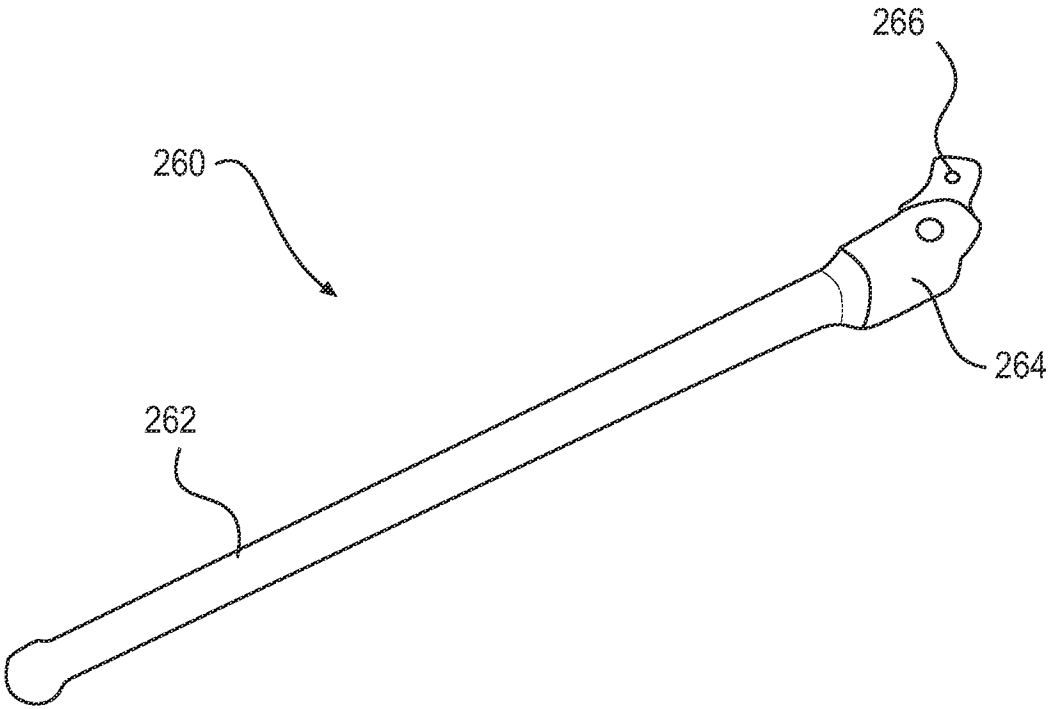
FIG. 8 is a perspective view of a conventional breaker bar for use with a cylinder liner installation tool, in accordance with aspects of the present disclosure.

The handle mount section 222 of the body 220 may be formed to have a socket 223 for connecting to a breaker bar 260. As shown in FIG. 8, for example, the breaker bar 260 has a solid handle section 262 and a head portion 264 for rotatably mounting a square fitting 266 to extend in swiveling fashion therefrom. The socket 223 may be sized to accept a ½ inch square fitting 266 of the breaker bar 260, although the socket 223 may be sized to accept any other suitable size breaker bar fittings. The breaker bar 260 may be, for example, a non-ratcheting type breaker bar or any socket wrench, including a ratcheting-head wrench, which may be used to provide the necessary configuration required by the user for mounting the cylinder liner 120 into the engine block 110.

Figure 5:
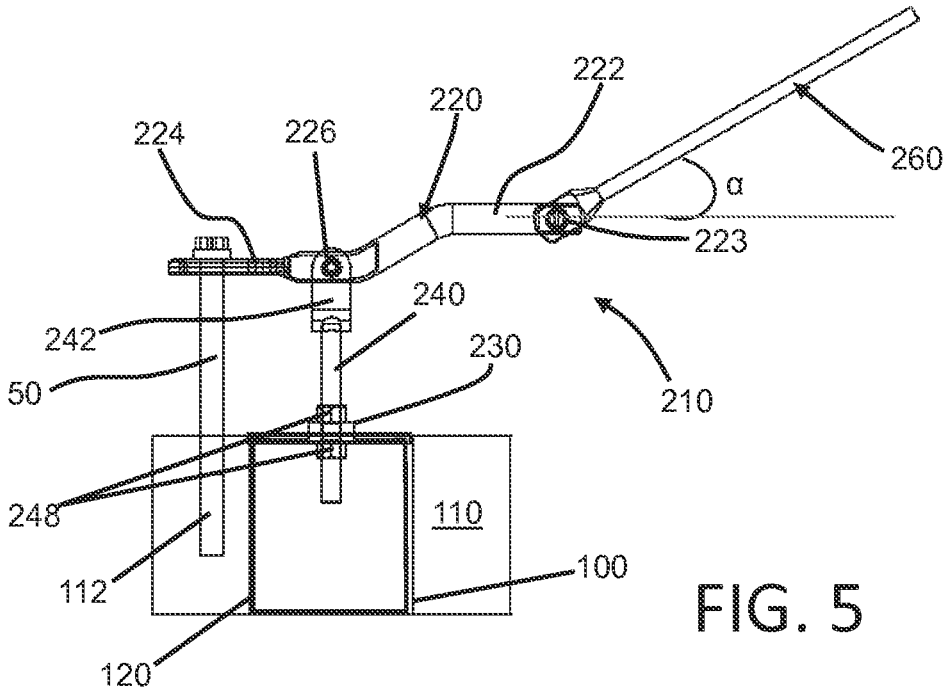
FIG. 5 is a side view of a cylinder liner installation tool, in accordance with aspects of the present disclosure.
Figure 6:
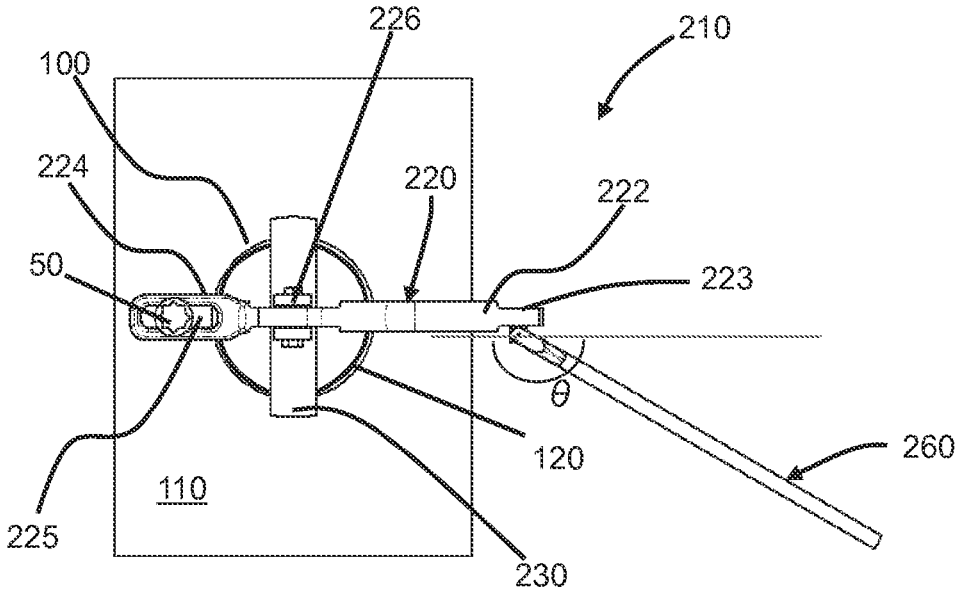
FIG. 6 is a top view of a cylinder liner installation tool, in accordance with aspects of the present disclosure.
Figure 7:
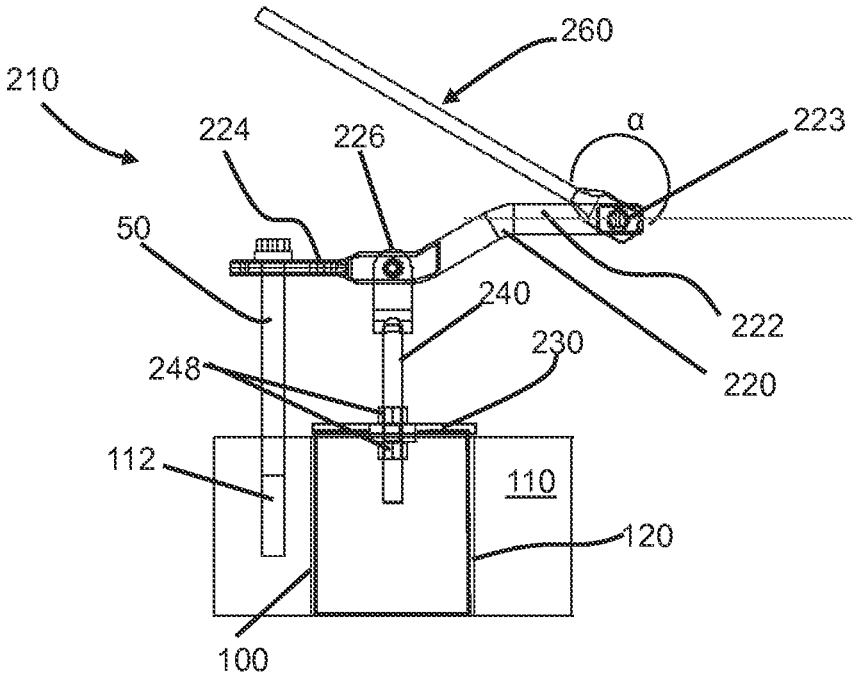
FIG. 7 is a side view of a cylinder liner installation tool illustrated in a position of use, in accordance with aspects of the present disclosure.

As shown in FIG. 6, a breaker bar 260 permits the effective handle of the tool 210 to be swiveled along a particular plane through an angle θ, which is typically at least 180°. Furthermore, as shown in FIGS. 5 and 7, the socket 223 of the handle mount section 222 may be configured to accept the fitting 266 at various angles and from either side of the tool 210. Accordingly, and in combination with its swiveling capability, the breaker bar 260 may be mounted in various configurations so that the effective handle of the tool 210, i.e., the breaker bar 260 in combination with the body 220, can be used to apply force to the press plate 230 from almost any position in the vicinity of the engine block 110.

Figure 9:
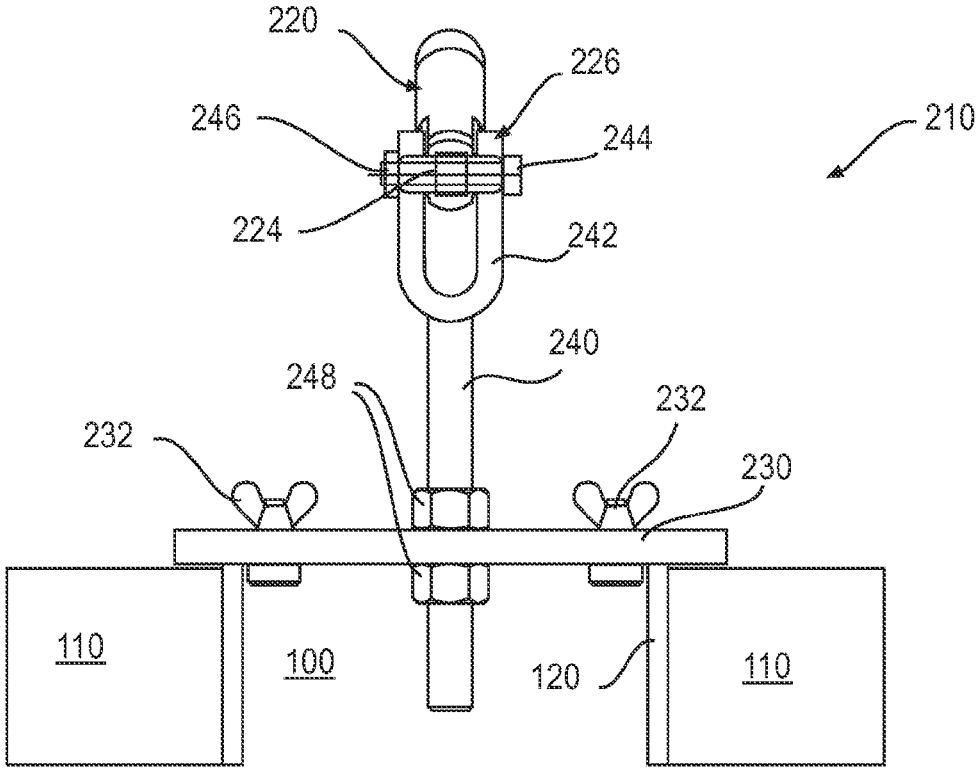
FIG. 9 is a front view of a cylinder liner installation tool, in accordance with aspects of the present disclosure.
Figure 10:
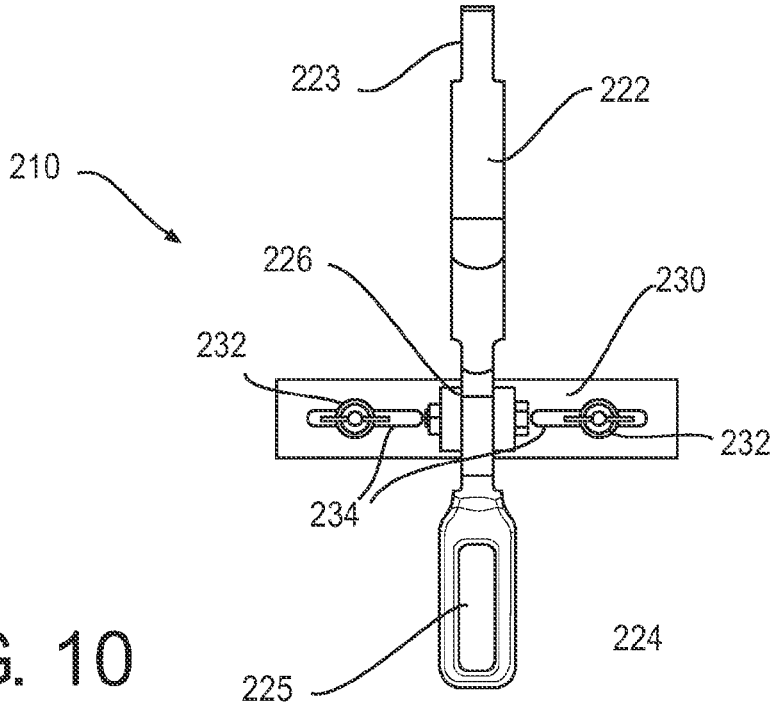
FIG. 10 is a top view of a cylinder liner installation tool, in accordance with aspects of the present disclosure.

As shown in FIGS. 9 and 10, in accordance with yet other aspects of the present invention, the press plate 230 may be formed to include adjustable slides 232. Symmetrical slots 234 may be formed on each side of the press plate 230 and mounted with the slides 232. Each slide 232 may be a wing nut and bolt assembly, for example, and permit the user to center the press plate 230 evenly over the cylinder liner 120 by sliding each slide 232 toward an outer perimeter of the press plate 230 until a lower portion of the slide 232 below the press plate 230 abuts an inner surface of the cylinder liner 120. The slides 232 may be locked into position, ensuring an even distribution of force will be applied to the cylinder liner 120 during use of the tool 210. Although disclosed herein as a rectangular plate, press plate 230 may be any suitable shape, including circular, such that planar contact is made with a plurality of points along the circumference of the upper surface of the cylinder liner flange 122. Similarly, any number of slides 232 may be used to center the tool 210 over any size cylinder liner. Surface markings may be applied to or formed in the surface of the press plate 230 near the slots 234 to assist a user in aligning the tool for even distribution of applied force during installation of the cylinder liner 120.

To use the device, a cylinder liner 120 is inserted into the cylinder 100 of engine block 110. The tool 210, with or without the breaker bar 260 mounted, is placed above the cylinder liner 120 so that the press plate 230 is centered as much as possible on the cylinder liner 120. The slides 232 are used to more accurately adjust the position of the press plate 230 to be symmetrically aligned above the cylinder liner 120. As shown in FIGS. 5-7, the head bolt mounting section 224 of the body 220 is formed with a slot 225 for receiving a head bolt 50. The head bolt 50 is extended through the slot 225 and threaded into a head bolt hole 112. At this point, depending on the length of the liner 120 extending above the cylinder bore, the repositioning nuts 248 may be adjusted to provide for nearly perpendicular application of force through the press rod 240 to the press plate 230. In so doing, the press rod 240 is substantially parallel to the head bolt 50 and the truncated handle section 222 extends perpendicular to the plane of the press plate 230.

With the tool 210 situated and set above the cylinder liner 120, as described above, if not previously mounted, the breaker bar 260 may be mounted to the tool 210 by inserting the fitting 266 into the socket 223 in the truncated handle section 222. In this manner, the breaker bar 260 may be mounted at a first angle a (see, e.g., FIGS. 5 and 7), to one particular side of the tool, and/or swiveled through a second angle θ (see FIG. 6) to be clear of structure that might otherwise interfere with the installation procedure, such as cowlings, etc. The two degrees of rotational freedom, as well as the flexibility to insert handles of varying length using tools, such as breaker bars or socket wrenches found in most service stations or garages, provides enormous flexibility and convenience to the technician installing the liners.

With the tool 210 set up and the breaker bar 260 in a convenient position for the technician, downward force may be applied to the breaker bar 260. With the hinge mount 226 acting as a fulcrum, and the head bolt 50 resisting rotation of the tool 210, the force applied to the breaker bar 260 is translated into a longitudinal force directed down through the press rod 240 to the press plate 230. The press plate 230, in turn, engages the cylinder liner 120 and, due to the symmetrical alignment of the tool 210, applies a substantially equal and distributed insertion force against the flange 122 of the cylinder liner 120. The cylinder liner 120 may thus be forced into the cylinder bore and seated with the flange 122 of the liner 120 protruding a predetermined distance from the top of the block 110, as previously discussed with reference to related tool 10 and FIG. 4. A dial indicator sled gauge, for example, may be used to measure the liner protrusion 124 to ensure it is within allowable tolerance.

With the cylinder liner 120 thus installed, the tool 210 may be removed by loosening the slides 232 and sliding each slide 232 away from abutment with the cylinder liner 120. The head bolt 50 may be removed from the head bolt hole 112 and disengaged from slot 225 so that the tool 210 is free to be removed and/or used to seat the next cylinder liner, if necessary.

It is to be understood that any feature described in relation to any one aspect may be used alone, or in combination with other features described, and may also be used in combination with one or more features of any other of the disclosed aspects, or any combination of any other of the disclosed aspects.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A cylinder liner installation tool for seating a cylinder liner into an engine block, the cylinder liner installation tool comprising:

a body having a handle mount section at a proximal end and a head bolt mounting section at a distal end;

a press rod hingedly attached to the body toward the distal end;

a press plate attached to the press rod, and a handle extension removably attached to the handle mount section, wherein the head bolt mounting section is configured to receive a head bolt mounted to the engine block so that application of an applied force to the handle extension results in a translation of the force down the press rod to the press plate, and wherein the handle extension is a breaker bar having a swiveling fitting.

2. The cylinder liner installation tool of claim 1, wherein the handle mount section has a socket for receiving the swiveling fitting.

3. The cylinder liner installation tool of claim 2, wherein the fitting is a square fitting and the socket is configured to receive the square fitting at a plurality of angles.

4. The cylinder liner installation tool of claim 1, wherein the press rod has external threading and repositioning nuts mounted thereon on either side of the press plate to adjustably mount the press plate at various positions along a length of the press rod.

5. The cylinder liner installation tool of claim 1, further comprising at least two adjustable slides, wherein the press plate has at least two symmetrical slots configured to receive and retain the slides.

6. The cylinder liner installation tool of claim 5, wherein the slide includes a wing nut attached to a bolt.

7. The cylinder liner installation tool of claim 1, wherein the press rod is formed with a U-bracket that when mounted to the body forms a hinge.

8. A method of installing a cylinder liner into a cylinder bore in an engine block, the method comprising the steps of:

providing a cylinder liner installation tool comprising:

a body having a handle mount section at a proximal end and a head bolt mounting section at a distal end;

a press rod hingedly attached to the body toward the distal end; and a press plate attached to the press rod;

inserting the cylinder liner into the cylinder bore;

centering the press plate over the cylinder liner;

extending a head bolt through the head bolt mounting section;

attaching the head bolt to the engine block;

attaching a handle extension to the handle mount section; and applying force to the handle extension that translates the force down the press rod to the press plate.

9. The method of installing a cylinder liner of claim 8, wherein the handle extension is a breaker bar having a swiveling fitting.

10. The method of installing a cylinder liner of claim 9, wherein the handle mount section has a socket for receiving the swiveling fitting.

11. The method of installing a cylinder liner of claim 10, wherein the fitting is a square fitting and the socket is configured to receive the square fitting at a plurality of angles.

12. The method of installing a cylinder liner of claim 8, wherein the press rod has external threading and the method further comprises adjusting a repositioning nut mounted on the external threading of the press rod to position the press plate at a predetermined location along a length of the press rod.

13. The method of installing a cylinder liner of claim 8, wherein the press plate has at least two symmetrical slots configured to receive and retain at least two locking slides, and the method further comprises the step of adjusting the at least two locking slides to abut the cylinder liner in order to center the press plate over the cylinder liner.

14. The method of installing a cylinder liner of claim 8, wherein the press rod includes a U-bracket for mounting the press rod onto the body and forming a hinged joint.

15. A cylinder liner installation tool comprising:

a body having a handle mount section at a proximal end and a head bolt mounting section at a distal end;

a press rod attached to the body;

a press plate attached to the press rod; and means for removably attaching a handle extension to the handle mount section, wherein the handle extension is a breaker bar or a socket wrench.

16. The cylinder liner installation tool of claim 15, further comprising means for symmetrically centering the press plate above a cylinder liner.

17. The cylinder liner installation tool of claim 15, further comprising means for adjustably positioning the handle extension in two orthogonal planes.

18. The cylinder liner installation tool of claim 15, wherein the press rod has means for attaching to the body such that a hinged joint is formed.

* * * * *